US011378322B2

(12) United States Patent
Jeong et al.

(10) Patent No.: US 11,378,322 B2
(45) Date of Patent: Jul. 5, 2022

(54) ICE STORAGE APPARATUS AND METHOD OF USE

(71) Applicant: Samsung Electronics Co., Ltd., Suwon-si (KR)

(72) Inventors: Jin Jeong, Yongin-si (KR); Bong Su Son, Cheonan-si (KR); Do Yun Jang, Suwon-si (KR); Yeon Woo Cho, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/658,730

(22) Filed: Oct. 21, 2019

(65) Prior Publication Data

US 2020/0049396 A1 Feb. 13, 2020

Related U.S. Application Data

(63) Continuation of application No. 14/813,539, filed on Jul. 30, 2015, now Pat. No. 10,495,366.

(30) Foreign Application Priority Data

Aug. 22, 2014 (KR) ..... 10-2014-0109445

(51) Int. Cl.
*F25C 5/187* (2018.01)
*F25C 5/20* (2018.01)
*F25C 1/00* (2006.01)

(52) U.S. Cl.
CPC ..... *F25C 5/187* (2013.01); *F25C 1/00* (2013.01); *F25C 5/22* (2018.01); *F25C 5/24* (2018.01);
(Continued)

(58) Field of Classification Search
CPC .... F25C 1/00; F25C 5/187; F25C 5/22; F25C 5/24; F25C 5/182; F25C 2400/00;
(Continued)

(56) References Cited

U.S. PATENT DOCUMENTS 4,344,295 A 8/1982 Linstromberg
4,424,683 A 1/1984 Manson
(Continued)

FOREIGN PATENT DOCUMENTS

CN 101520269 9/2009
CN 102997536 3/2013
(Continued)

OTHER PUBLICATIONS

Partial European Search Report dated Dec. 23, 2015 in European Patent Application No. 15181722.8.
(Continued)

*Primary Examiner* — Henry T Crenshaw
(74) *Attorney, Agent, or Firm* — Staas & Halsey LLP

(57) ABSTRACT

A refrigerator is provided. The refrigerator includes a body having a storage compartment, an ice making device, and an ice bucket to store the generated ice. The ice bucket includes an ice bucket body, an ice storage space inside the ice bucket body, and a spacing member to allow ice to be spaced apart from the ice bucket body toward the ice storage space to secure a flow path of cool air, so that the cool air smoothly flows inside the ice bucket body. A full-ice detecting sensor having an emitter and a receiver to receive optical signals is provided. A control unit determines a full-ice status by receiving an output value of signals received from the full-ice detecting sensor.

11 Claims, 12 Drawing Sheets

(52) U.S. Cl.
CPC ..... *F25C 2400/00* (2013.01); *F25C 2700/02* (2013.01)

(58) Field of Classification Search
CPC ..... F25C 2700/02; F25D 23/04; F25D 2317/0665; F25D 2317/062
See application file for complete search history.

(56) References Cited

U.S. PATENT DOCUMENTS 4,475,357 A 10/1984 Linstromberg
4,733,539 A 3/1988 Josten
4,756,165 A 7/1988 Chestnut
4,774,814 A 10/1988 Yingst
4,799,362 A 1/1989 Chestnut
4,872,317 A 10/1989 Reed
4,938,030 A 7/1990 Josten
4,947,653 A 8/1990 Day
5,042,263 A 8/1991 Day
5,056,325 A 10/1991 Josten
5,129,237 A 7/1992 Day
5,160,094 A 11/1992 Willis
5,187,948 A 2/1993 Frohbieter
5,261,248 A 11/1993 Willis
5,297,394 A 3/1994 Frohbieter
5,477,694 A 12/1995 Black
5,653,114 A 8/1997 Newman
5,794,451 A 8/1998 Lee
5,829,257 A 11/1998 Newman
5,878,583 A 3/1999 Schlosser
5,931,003 A 8/1999 Newman
6,257,465 B1 7/2001 Treadwell
6,282,909 B1 9/2001 Newman
6,286,324 B1 9/2001 Pastryk
6,314,745 B1 11/2001 Janke
6,351,955 B1 3/2002 Oltman
6,463,746 B1 10/2002 Bethuy
6,574,974 B1 6/2003 Herzog
6,581,392 B1 6/2003 Gist
6,679,073 B1 1/2004 Hu
6,705,091 B1 3/2004 Kim
7,318,323 B2 1/2008 Tatsui
8,281,613 B2 10/2012 An
8,464,543 B2 6/2013 Visin
9,377,234 B2 6/2016 Jeong
2001/0011460 A1 8/2001 Tchougounov
2001/0025505 A1 10/2001 Nelson
2002/0007638 A1 1/2002 Tchougounov
2002/0020177 A1 2/2002 Billman
2002/0083726 A1 7/2002 Kim
2002/0104322 A1 8/2002 Horey
2003/0145608 A1 8/2003 Billman
2004/0117041 A1 6/2004 Broadbent
2004/0194480 A1 10/2004 Kim
2005/0109056 A1 5/2005 Rand
2005/0132739 A1 6/2005 Sannasi
2005/0138937 A1 6/2005 Shoukyuu
2006/0086107 A1 4/2006 Voglewede
2006/0086134 A1 4/2006 Voglewede
2006/0090485 A1 5/2006 Lee
2006/0201170 A1 9/2006 Cole
2006/0242971 A1 11/2006 Cole
2006/0276932 A1 12/2006 Pearson
2006/0277928 A1 12/2006 McDougal
2007/0084229 A1 4/2007 Han
2007/0157636 A1 7/2007 Billman
2008/0034780 A1 2/2008 Lim
2008/0072610 A1 3/2008 Venkatakrishnan
2008/0092567 A1 4/2008 Doberstein
2008/0092574 A1 4/2008 Doberstein
2008/0156011 A1 7/2008 Culley
2008/0236187 A1 10/2008 Kim
2008/0295539 A1 12/2008 An
2009/0165471 A1 7/2009 Rafalovich
2009/0173085 A1 7/2009 Broadbent
2009/0205358 A1 8/2009 Smtih
2009/0211292 A1 8/2009 Smith
2009/0272130 A1 11/2009 Kim
2009/0293509 A1 12/2009 Kim
2009/0293510 A1* 12/2009 Kim ..... F25C 5/187 62/73
2009/0308085 A1 12/2009 DeVos
2010/0089075 A1 4/2010 Park
2010/0101259 A1 4/2010 Lee
2010/0122543 A1 5/2010 Lee
2010/0139299 A1 6/2010 Lee
2010/0161137 A1 6/2010 Kim
2010/0204832 A1 8/2010 Choi
2010/0218518 A1 9/2010 Ducharme
2010/0218540 A1 9/2010 McCollough
2010/0257875 A1 10/2010 Kim
2010/0257889 A1 10/2010 Lee
2010/0313594 A1 12/2010 Lee
2011/0023510 A1 2/2011 Lee
2011/0100039 A1 5/2011 Kim
2011/0113799 A1* 5/2011 Snider ..... G01J 1/0266 62/137
2011/0146312 A1 6/2011 Hong
2012/0000216 A1* 1/2012 Kim ..... F25C 1/00 62/66
2012/0031115 A1 2/2012 Mueller
2012/0031126 A1 2/2012 Zhang
2012/0036872 A1 2/2012 Junge
2012/0111041 A1 5/2012 Mitchell
2012/0118001 A1 5/2012 Mitchell
2012/0125018 A1 5/2012 Shaha
2012/0174613 A1 7/2012 Park
2012/0192575 A1 8/2012 Tirumala
2012/0204592 A1 8/2012 Foster
2012/0222432 A1 9/2012 Lopes
2012/0304676 A1 12/2012 White
2012/0304680 A1* 12/2012 Oh ..... F25C 5/22 62/320
2012/0304684 A1 12/2012 Shaha
2012/0324916 A1 12/2012 Bortoletto
2013/0000337 A1 1/2013 Krause
2013/0092707 A1 4/2013 Kim
2013/0167569 A1 7/2013 Lee
2013/0167574 A1 7/2013 Yoon
2013/0167575 A1 7/2013 Hong
2013/0167576 A1 7/2013 Kim
2013/0174596 A1 7/2013 Kim
2013/0174598 A1 7/2013 Ha
2013/0174599 A1 7/2013 Jeong
2013/0305765 A1 11/2013 Grewal
2013/0327069 A1 12/2013 Styn
2014/0013792 A1 1/2014 Lee
2014/0196478 A1 7/2014 Severance
2014/0208781 A1 7/2014 Broadbent

FOREIGN PATENT DOCUMENTS

CN 103363752 10/2013
DE 20 2007 004 580 U1 6/2007
EP 0 089 733 A2 9/1983
EP 0 089 733 A3 9/1983
EP 2 239 528 10/2010
JP 54-34171 3/1979
JP 8-100977 4/1996
KR 20-2000-0009946 6/2000
KR 10-0584273 5/2006
KR 10-2009-0109418 10/2009
KR 10-2009-0123338 12/2009
KR 10-2010-0113206 10/2010
KR 10-2011-0072366 6/2011
WO 2012/074323 A2 6/2012
WO 2012/074323 A3 6/2012

OTHER PUBLICATIONS

European Office Action dated Jun. 14, 2017 in corresponding European Patent Application No. 15 181 722.8.
Chinese Office Action dated Jun. 2, 2017 in corresponding Chinese Patent Application No. 201510520936.1.

(56) References Cited

OTHER PUBLICATIONS

European Notice of Allowance dated Mar. 23, 2018 in corresponding European Patent Application No. 15 181 722.8, 39 pgs.
Chinese Office Action dated Feb. 12, 2018, in corresponding Chinese Patent Application No. 201510520936.1, 16 pgs.
Chinese Notice of Allowance dated May 23, 2018 in corresponding Chinese Patent Application No. 201510520936.1, 5 pgs.
Partial European Search Report dated Oct. 12, 2018 in European Patent Application No. 18186038.8.
Extended European Search Report dated Dec. 21, 2018 in European Patent Application No. 18186038.8.
US Notice of Allowance dated Jul. 30, 2019 in U.S. Appl. No. 14/813,539.
US Office Action dated Apr. 8, 2019 in U.S. Appl. No. 14/813,539.
US Office Action dated Nov. 20, 2018 in U.S. Appl. No. 14/813,539.
US Office Action dated Jun. 20, 2018 in U.S. Appl. No. 14/813,539.
US Office Action dated Aug. 9, 2017 in U.S. Appl. No. 14/813,539.
US Office Action dated Jan. 26, 2017 in U.S. Appl. No. 14/813,539.
U.S. Appl. No. 14/813,539, filed Jul. 30, 2015, Jin Jeong, et al., Samsung Electronics Co., Ltd.
Korean Notice of Allowance dated Apr. 27, 2021, in corresponding Korean Patent Application No. 10-2014-0109445.
Korean Office Action dated Nov. 19, 2020 in Korean Patent Application No. 10-2014-0109445.

* cited by examiner

ICE STORAGE APPARATUS AND METHOD OF USE

CROSS-REFERENCE TO RELATED APPLICATIONS

This application is a continuation application of U.S. patent application Ser. No. 14/813,539, filed on Jul. 30, 2015, which claims the priority benefit of Korean Patent Application No. 10-2014-0109445, filed on Aug. 22, 2014, in the Korean Intellectual Property Office, the disclosures of which are incorporated herein by reference.

BACKGROUND

1. Field

Embodiments of the present disclosure relate to a refrigerator having an ice making device and an ice bucket, and more particularly, to a cool air flow structure and a full-ice detecting structure of an ice bucket.

2. Description of the Related Art

In general, a refrigerator is an appliance configured to store foods in a fresh status while having a storage compartment to store the foods and a cool air supplying apparatus to supply cool air to the storage compartment. The storage compartment is provided inside a body, and is provided with a front surface thereof open. The open front surface of the storage compartment may be open/closed by a door.

An ice making device to generate ice and an ice bucket to store the ice generated at the ice making device may be provided at the refrigerator. The ice stored at the ice bucket may be withdrawn through a dispenser of the door when desired by a user. Cool air is needed to be supplied to the ice bucket to prevent the ice stored at the ice bucket from melting prior to a user withdrawing the ice stored at the ice bucket.

With respect to an automatic ice-making apparatus at which an ice-making cycle including a supplying of water, a making of ice, and a moving of ice automatically occurs, the automatic ice making device is configured to determine whether to repeat or stop the ice-making cycle by determining if the ice bucket is full of ice.

A full-ice detecting sensor to detect the full-ice status and a control unit to determine the full-ice status on the basis of an output signal from the full-ice detecting sensor may be provided at the refrigerator.

SUMMARY

It is an aspect of the present disclosure to provide a structure configured to supply cool air to an ice bucket to cool the ice stored at the ice bucket, and a structure of the ice bucket configured so cool air may easily be circulated in the ice bucket.

It is an aspect of the present disclosure to provide a refrigerator having an optical sensor serving as a full-ice detecting sensor to provide a mounting structure of the optical sensor capable of increasing reliability of detecting full ice, and a full-ice detecting algorithm.

Additional aspects of the disclosure will be set forth in part in the description which follows and, in part, will be obvious from the description, or may be learned by practice of the disclosure.

In accordance with an aspect of the present disclosure, a refrigerator includes a body, an ice making device and an ice bucket. The body may have a storage compartment. The ice making device may be configured to generate ice. The ice bucket may be configured to store the ice generated at the ice making device. The ice bucket may include an ice bucket body, an ice storage space formed at an inside the ice bucket body, and a spacing member to allow ice to be spaced apart from the ice bucket body toward the ice storage space to secure a flow path of cool air.

The spacing member may be integrally provided with the ice bucket body, and may be protruded from the ice bucket body toward the ice storage space.

The spacing member may include a plurality of guide ribs extendedly formed lengthways in vertical directions at both side walls of the ice bucket.

Guide ribs adjacent to each other among the plurality of guide ribs may form a cool air flow path while spaced apart from each other by a predetermined gap.

The spacing member may include a dividing wall extendedly formed at inner sides of the plurality of guide ribs to divide the cool air flow path.

A cool air communication hole may be formed at the dividing wall to have cool air communicated after the cool air is penetrated through the dividing wall.

The spacing member may include a plurality of bottom ribs extendedly formed in lengthways in horizontal directions at a bottom of the ice bucket.

The ice bucket may include a cool air inlet and a cool air outlet each formed at an upper wall of the ice bucket to have cool air introduced and discharged.

The cool air inlet may be formed adjacent to one side wall of the ice bucket, and the cool air outlet may be formed adjacent to an opposite side wall of the ice bucket.

In accordance with an aspect of the present disclosure, a refrigerator includes a body, a door, an ice making device, an ice storage compartment, an ice bucket and a full-ice detecting sensor. The body may have a storage compartment. The door may be configured to open/close the storage compartment. The ice making device may be disposed at a ceiling of the storage compartment to generate ice. The ice storage compartment may be provided at the door. The ice bucket may be mounted at the ice storage compartment to store the ice generated at the ice making device. The full-ice detecting sensor may have an emitter to radiate optical signals and a receiver to receive optical signals to detect the full-ice status at the ice bucket, while provided at the ice storage compartment to be positioned at an outside the ice bucket.

The ice storage compartment may include an ice storage compartment body having a left side wall, a right side wall, a rear wall, and a bottom, and an ice bucket mounting space formed at an inside the ice storage compartment body.

The full-ice detecting sensor may be installed at the ice storage compartment body.

One of the emitter and the receiver may be installed at the left side wall or the right side wall of the ice storage compartment, and the remaining one of the emitter and the receiver may be installed at the rear wall of the ice storage compartment, so that an optical path in between the emitter and the receiver is diagonally formed.

The ice bucket may include an ice bucket body and a storage space formed at an inside the ice bucket body, and an optical hole may be formed at the ice bucket body so that the optical signals transmitted/received through the full-ice detecting sensor are penetrated through the ice bucket body.

In accordance with an aspect of the present disclosure, a refrigerator includes a body, an ice making device, a water supplying device, an ice bucket, an ice moving device, a full-ice detecting sensor and a control unit. The body may have a storage compartment. The ice making device may be configured to generate ice. The water supplying device may be configured to supply water to the ice making device. The ice bucket may be configured to store ice. The ice moving device may be configured to move the ice generated at the ice making device to the ice bucket. The full-ice detecting sensor may have an emitter to radiate an optical signal to an inside the ice bucket, and a receiver to receive the optical signal radiated from the emitter and output a value of the received optical signal. The control unit may be configured to primarily determine a full-ice status by turning the full-ice detecting sensor on, turning the full-ice detecting sensor off during a predetermined standby time upon determining to be in the full-ice status as a result of the primary determination of the full-ice status, and secondarily determine the full-ice status by turning the full-ice detecting sensor on when the predetermined standby time is elapsed.

The control unit may control the ice moving device and the water supplying device to finish an ice-making cycle having a supplying of water, a making of ice, and a moving of ice, upon determining to be in the full-ice status as a result of the secondary determination on the full-ice status.

The control unit may control the ice moving device and the water supplying device to proceed with an ice-making cycle having a supplying of water, a making of ice, and a moving of ice, upon determining not to be in the full-ice status as a result of the secondary determination on the full-ice status.

The control unit may control the ice moving device and the water supplying device to proceed with an ice-making cycle including a supplying of water, a making of ice, and a moving of ice, upon determining not to be in the full-ice status as a result of the secondary determination on the full-ice status.

The refrigerator may further include a sensor heater to heat the full-ice detecting sensor. The control unit may turn the sensor heater on to heat the full-ice detecting sensor upon determining to be in the full-ice status as a result of the primary determination on the full-ice status.

The control unit may turn the sensor heater off when the predetermined standby time is elapsed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
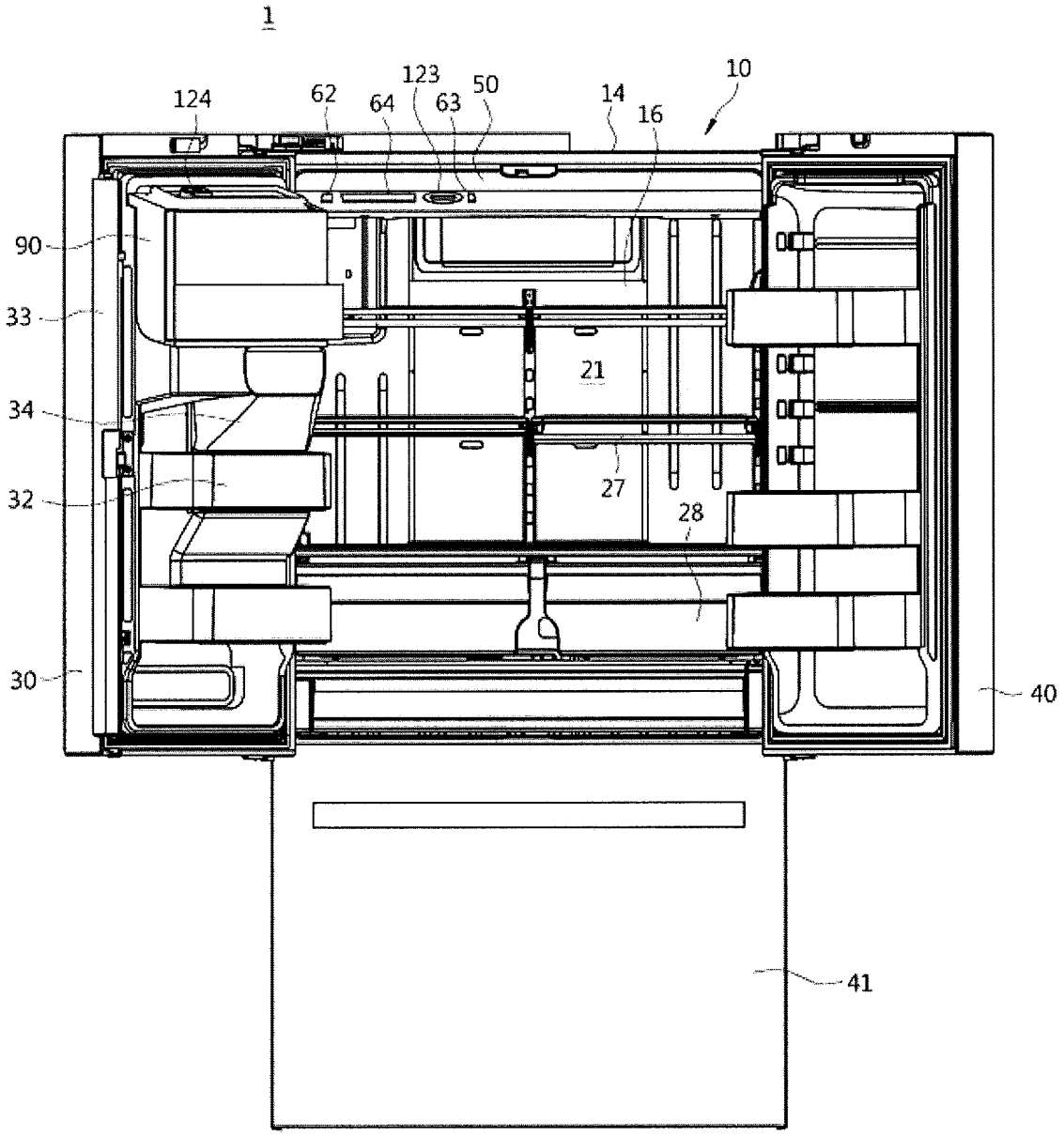
FIG. 1 illustrates a refrigerator in accordance with an embodiment of the present disclosure.

Reference will now be made in detail to the embodiments of the present disclosure, examples of which are illustrated in the accompanying drawings, wherein like reference numerals refer to like elements throughout.

Figure 2:
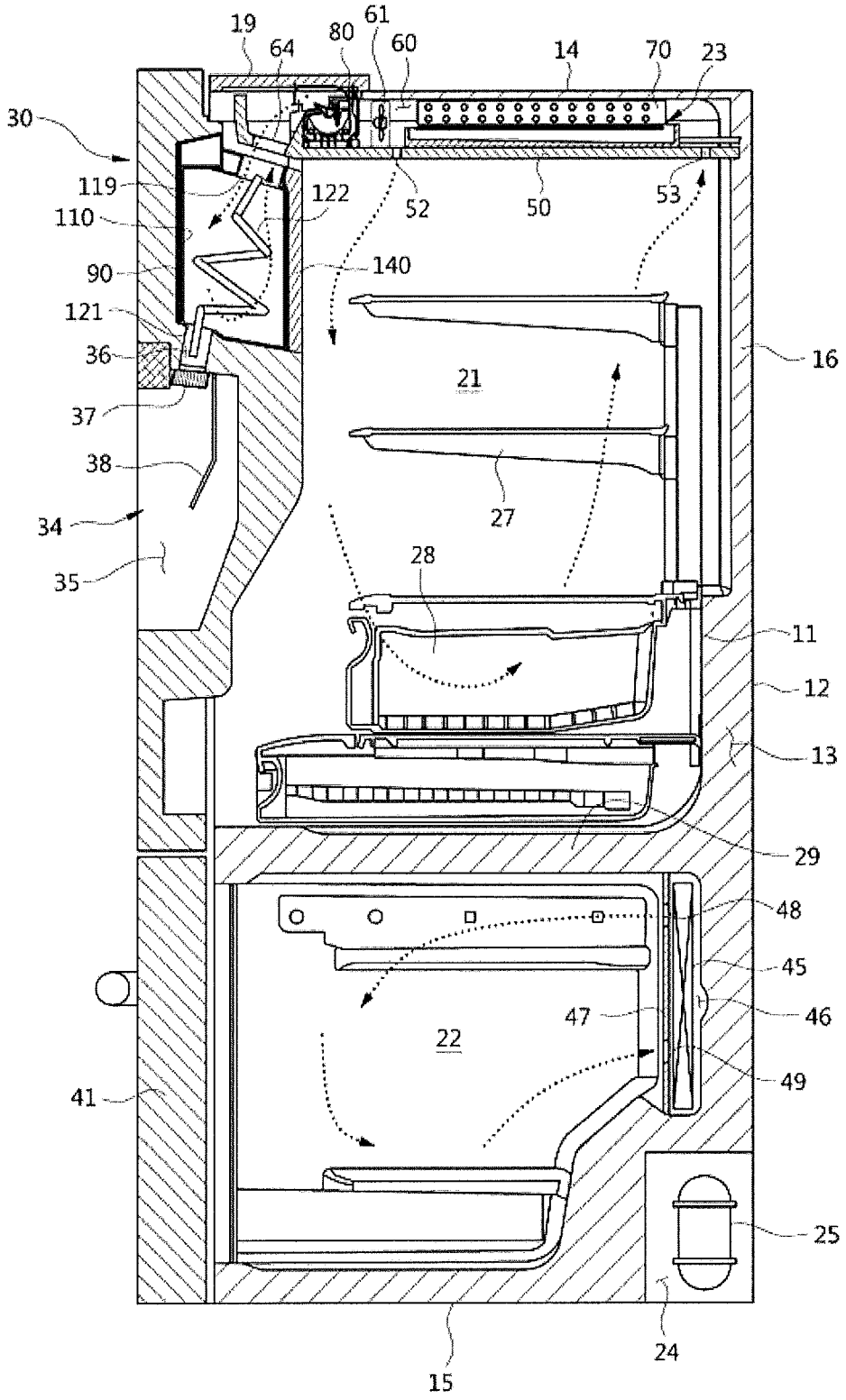
FIG. 2 is an exemplary schematic side cross-sectional view of the refrigerator of FIG. 1.
Figure 3:
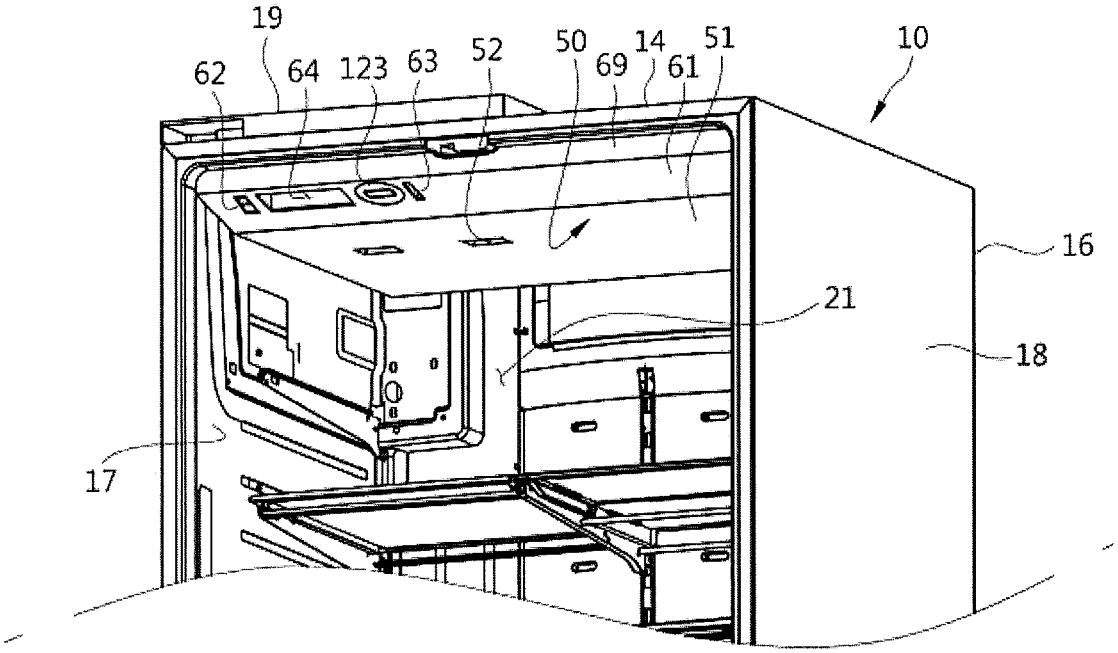
FIG. 3 illustrates an exemplary ceiling of the refrigerator of FIG. 1.
Figure 4:
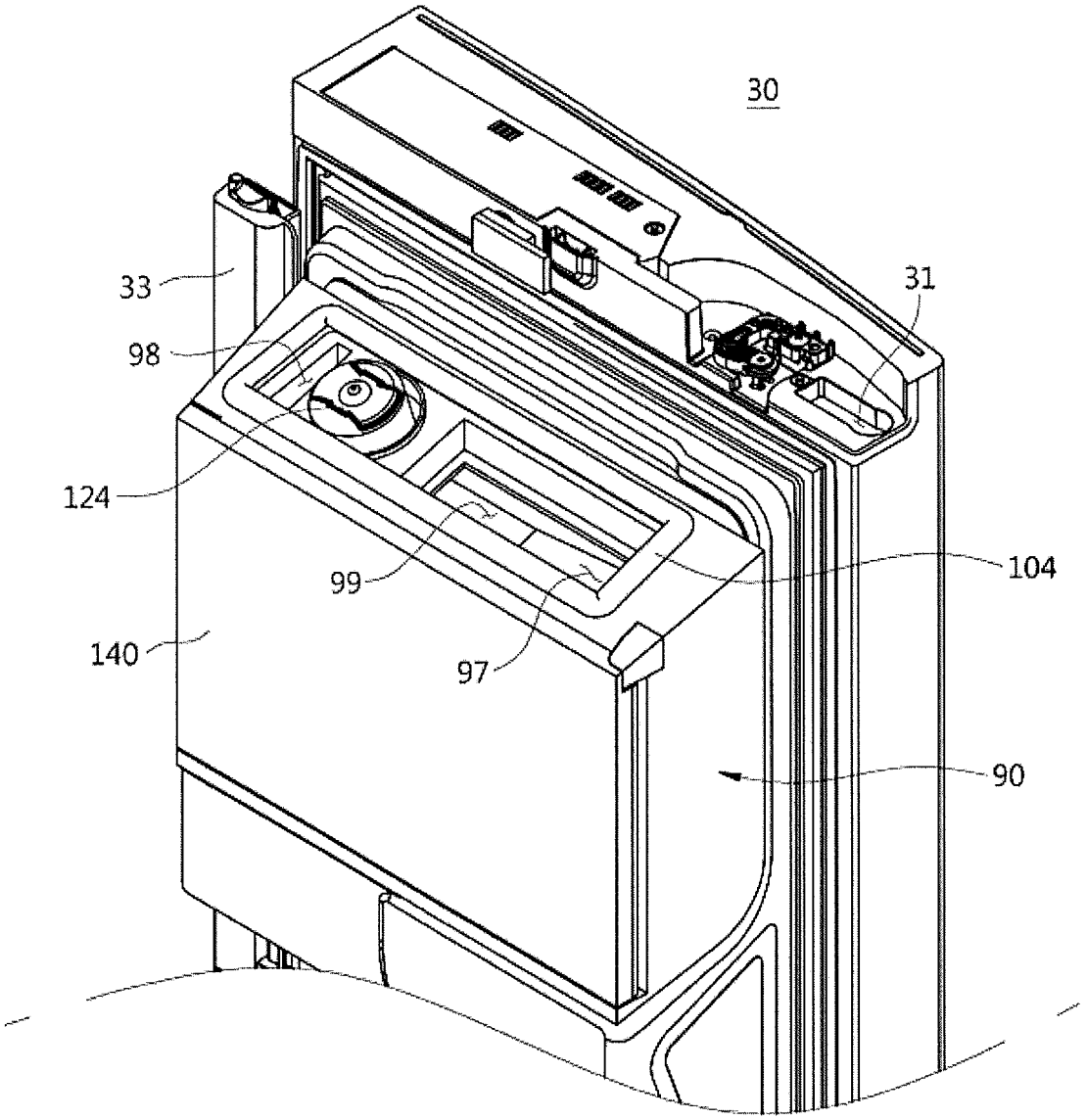
FIG. 4 illustrates an exemplary ice bucket of a door of the refrigerator of FIG. 1.

FIG. 1 illustrates an exemplary refrigerator in accordance with an embodiment of the present disclosure, FIG. 2 is an exemplary schematic side cross-sectional view of the refrigerator of FIG. 1, FIG. 3 illustrates an exemplary ceiling of the refrigerator of FIG. 1, and FIG. 4 illustrates an exemplary ice bucket of a door of the refrigerator of FIG. 1.

Referring to FIG. 1 to FIG. 5, a refrigerator 1 in accordance with an embodiment of the present disclosure includes a body 10, storage compartments 21 and 22 formed, for example, at an inside the body 10, a cool air supplying apparatus 23 to generate cool air, and doors 30, 40, and 41 to open/close the storage compartments 21 and 22.

The body 10 may be provided with the approximate shape of a box, and may include an inner case 11 and an outer case 12. The inner case 11 may be formed with resin material, and may form the storage compartments 21 and 22 at an inside thereof. The outer case 12 may be coupled to an outer side of the inner case 11, and may be formed with metallic material. A foamed insulation material 13 may be filled in between the inner case 11 and the outer case 12 to insulate the storage compartments 21 and 22.

The body 10 may include an upper wall 14, a bottom 15, a rear wall 16, a left side wall 17, and a right side wall 18.

The storage compartments 21 and 22 may be divided into an upper storage compartment 21 and a lower storage compartment 22 by a middle dividing wall 29. The upper storage compartment 21 may be used as a refrigerating compartment, and the lower storage compartment 22 may be used as a freezing compartment. According to an exemplary embodiment, the upper storage compartment 21 may be used as a freezing compartment, and the lower storage compartment 22 may be used as a refrigerating compartment. That is, the refrigerator may be provided in the form of a BMF (Bottom Mounted Freezer) type or a TMF (Top Mounted Freezer) type.

The storage compartments of a refrigerator may be divided into left and right sides by a vertical dividing wall. That is, the refrigerator may be in the form of a SBS (Side By Side) type. According to an exemplary embodiment, a refrigerator may be provided with one storage compartment without a separate dividing wall. Even in the form of the refrigerator as such, aspects of the present disclosure may be applied.

Each of the storage compartments 21 and 22 may be provided with a front surface thereof to deposit/withdraw foods. The open front surfaces may be open/closed by the doors 30, 40, and 41. The upper storage compartment 21 may be open/closed by the plurality of rotating doors 30 and 40. The lower storage compartment 22 may be open/closed by the drawer-type door 41 configured to be inserted into/withdrawn from an inside.

A shelf 27 capable of supporting foods and a sealed container 28 to store foods in a sealed status may be provided at the storage compartment 21.

A door guard 32 at which foods are stored may be provided at a lower surface of the door 30. An ice bucket 110 to store the ice generated at an ice making device 80 and an ice storage compartment 90 at which the ice bucket 110 may be mounted may be provided at the door 30. A rotating axis hole 31 into which a hinge axis (not shown) may be coupled so that the door 30 may be rotated, and a filler member 33 to prevent the cool air of the storage compartment 21 from released by sealing the in between of the door 30 and the door 40 in a status of the doors 30 and 40 closed may be provided at the door 30.

A dispenser 34 at which a user may be supplied with water or ice without having to open the doors 30 and 40 may be provided at the door 30. The dispenser 34 may include a dispensing space 35 concavely formed at a front surface of the door 30 so that a user may be supplied with water or ice by inserting a container such as a cup thereinto, a chute 36 connecting an outlet 121 of the ice bucket 110 to the dispensing space 35 of the dispenser 34, an opening/closing member 37 to open/close the chute 36, and a dispensing switch 38 to drive the opening/closing member 37.

When the opening/closing member 37 is open/closed, for example, by driving the dispensing switch 38, the ice stored at the ice bucket 110 is descended into the dispensing space 35 through the chute 36, so that a user may be supplied with ice without opening the doors 30 and 40.

The cool air supplying apparatus 23 may be configured to form cool air by circulating a cooling cycle, and may supply the generated cool air to the storage compartments 21 and 22. The cool air supplying apparatus 23 may include a cooling cycle apparatus having a compressor 25, a condenser (not shown), an expansion apparatus (not shown), and evaporators 45 and 70, a refrigerant pipe 26 to guide refrigerant to the each cooling cycle apparatus, and a draft fan 61 to forcedly flow air as to supply the cool air generated at the evaporators 45 and 70 to the storage compartments 21 and 22. The compressor 25 may be disposed at a machinery compartment 24 formed at a lower portion of the body 10.

The cool air supplying apparatus 23 may include the plurality of evaporators 45 and 70 to independently cool the upper storage compartment 21 and the lower storage compartment 22. In the present embodiment, the upper evaporator 70 may cool the upper storage compartment 21, and the lower evaporator 45 may cool the lower storage compartment 22. The upper evaporator 70 may cool the ice bucket 110 provided at the door 30. According to an exemplary embodiment, the upper storage compartment 21 and the lower storage compartment 22 may be simultaneously cooled by use of a single evaporator.

The lower evaporator 45 may be disposed at a lower cooling space 47 separately divided by a cover 46. The cool air generated at the lower evaporator 45 may be supplied to the lower storage compartment 22 through a supplying hole 48 formed at the cover 46, and after circulating in the lower storage compartment 22, through a collecting hole 49 formed at the cover 46, the cool air may be collected to the lower cooling space 47. A draft fan (not shown) to forcedly flow cool air may be provided at the supplying hole 48 or the collecting hole 49.

The upper evaporator 70 may be disposed at an upper side of an inside the upper storage compartment 21. Hereinafter, for convenience of descriptions, the upper evaporator 70 is referred to the evaporator 70, and the upper storage compartment 21 is referred to the storage compartment 21.

The upper evaporator 70 may be disposed at a cooling space 60 formed between a cover plate 50 disposed at an inside the upper storage compartment 21 and the upper wall 14 of the body 10. The cooling space 60 may be divided by the cover plate 50 from a remaining domain of the storage compartment 21 while excluding the cooling space 60. As the evaporator 70 may be disposed at an inside the cooling space 60, the inside the cooling space 60 may be directly cooled by the cool air generated at the evaporator 70 without a separate duct structure.

The draft fan 61 may be provided at the cooling space 60 to increase heat-exchanging efficiency of the evaporator 70 and circulate cool air by forcedly circulating air. The draft fan 61 may be provided at a front of the evaporator 70. Therefore, the draft fan 61 may be provided to inlet air from a rear of the evaporator 70, heat-exchange the inlet air by having the inlet air pass through the evaporator 70, and forcedly flow the air cooled through the evaporator 70 toward a front of the evaporator 70.

The refrigerator 1 may include the ice making device 80 to generate ice. The ice making device 80 may include an ice-making cell 83 configured to accommodate water and generate ice while provided with the approximate shape of a semicircle, a scraper (not shown) rotatably provided to move the ice generated at the ice-making cell 83 from the ice-making cell 83, a driving unit (not shown) having an ice-moving device 81 to provide a driving force to rotate the scraper (not shown), and a slider (not shown) inclinedly formed as to descend the ice moved from the ice-making cell 83 to the ice bucket 110 provided at the door.

According to an exemplary embodiment, the ice making device 80 may be provided at a front of the evaporator 70. Therefore, the cool air generated at the evaporator 70 may be provided to flow toward the ice making device 80 by the draft fan 61, and ice may be generated at the ice making device 80 by the cool air as such. The ice making device 80 may be provided in the form of a direct-cooling type ice making device configured to be delivered with cooling energy as a direct contact is made with the refrigerant pipe 26.

In a case when the height of the ice making device 80 prevents complete accommodation at the cooling space 60, the upper wall 14 of the body 10 may be partially provided with an open portion thereof as to accommodate the ice making device 80. An upper cover 19 (see, for example, FIG. 2) may be coupled to the open portion, or the upper wall 14 of the body 10 may protrude in some degree toward an upper side.

The cover plate 50 may be divide the cooling space 60, and the remaining domain of the storage compartment 21 while excluding the cooling space 60, and cover the components disposed at the cooling space 60. The cover plate 50 may be provided with the shape of a plate. The cover plate 50 may be provided with the shape of a bent plate.

The cover plate 50 may include a body unit 51, a front inclination unit 61 inclinedly formed at a front of the body unit 51, and a front surface unit 69 configured to prevent the cooling space 60 from being exposed to a front while inclinedly formed at the front of the front inclination unit 61. The front surface unit 69 may be vertically formed.

According to an exemplary embodiment, the body unit 51 may be formed to be in an approximately horizontal manner, but is not limited hereto, and the body unit 51 may be inclinedly formed.

The body unit 51 may be provided with a cooling air supplying hole 52 formed thereto as to supply the cool air of the cooling space 60 to the storage compartment 21, and a cool air collecting hole 53 formed thereto to collect the cool air heated at the storage compartment 21 to the cooling space 60.

The cooling air supplying hole 52 and the cool air collecting hole 53 each may be provided with at least one unit thereof. The cooling air supplying hole 52 may be provided at a front of the evaporator 70, and the cool air collecting hole 53 may be provided at a rear of the evaporator 70. As illustrated on FIG. 2, the air introduced into the cooling space 60 from the storage compartment 21 through the cool air collecting hole 53 may be heat-exchanged and cooled at the evaporator 70, and may be stored at the storage compartment 21 through the cooling air supplying hole 52 at the front of the evaporator 70.

The front inclination unit 61 may be provided with an ice passing unit 64 formed thereto as the ice of the ice making device 80 is descended to the ice bucket 110 through the ice passing unit 64, an ice bucket cool air supplying hole 62 formed thereto as to supply the cool air of the cooling space 60 to the ice bucket 110, an ice bucket cool air collecting hole 63 formed thereto as to collect the cool air heated at the ice bucket 110 to the cooling space 60, and a coupler coupling hole 65 formed thereto as coupler apparatuses 123 and 124 may be coupled to the coupler coupling hole 65 to deliver a driving force at a stirrer 122 of the ice bucket 110.

The cover plate 50 may be coupled to an upper portion of an inner side of the storage compartment 21 after the components such as the evaporator 70 and the draft fan 61 are coupled to the upper wall 14 of the body 10. The components such as the evaporator 70 and the draft fan 61 may be coupled to the upper wall 14 of the body 10 of the refrigerator 1 through one of various coupling structures such as a hooking structure, an inserting structure, and a screw-fastening structure. The cover plate 50 may be coupled to the upper wall 14 of the body 10 of the refrigerator 1 through one of the various coupling structures such as the hooking structure, the inserting structure, and the screw-fastening structure.

According to an exemplary embodiment, the cover plate 50 may be coupled to an upper portion of an inner side of the storage compartment 21 after the components such as the evaporator 70 and the draft fan 61 are assembled at an upper surface of the cover plate 50.

The height of the cooling space 60, that is, the height in between the cover plate 50 and the upper wall 14 of the body 10, may not be large, and thus the evaporator 70 may be horizontally disposed in the cooling space 60.

Figure 5:
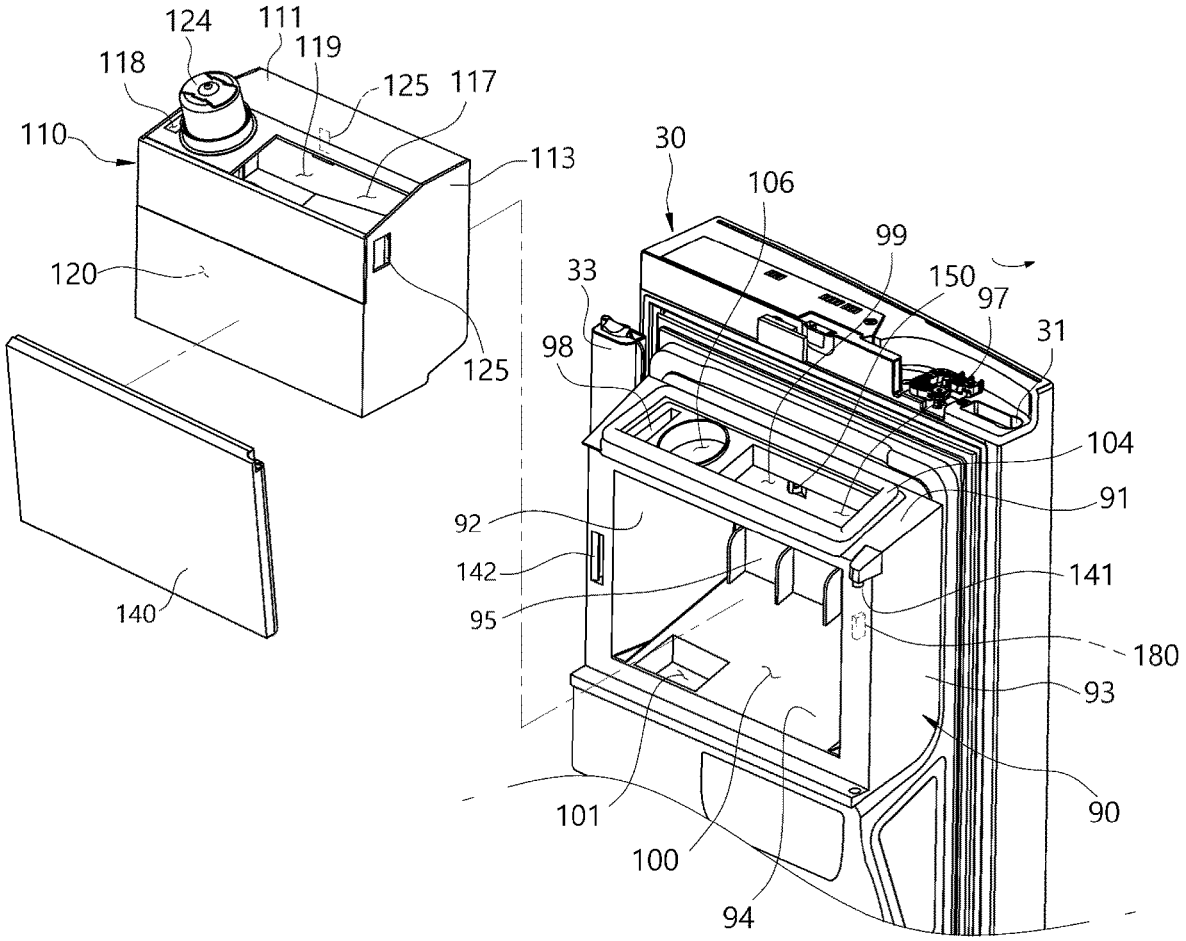
FIG. 5 illustrates an exemplary ice bucket disassembled from the door of the refrigerator of FIG. 1.

FIG. 5 illustrates a view of the ice bucket removed from the door of the refrigerator of FIG. 1.

As illustrated in FIG. 5, the ice storage compartment 90 may be provided at a lower surface of the door 30, and the ice bucket 110 may be mounted at the ice storage compartment 90. The ice storage compartment 90 includes a mounting space 100 capable of mounting the ice bucket 110. The ice storage compartment 90 may be provided with a front surface thereof open to deposit/withdraw the ice bucket 110 with respect to the mounting space 100. The open front surface of the ice storage compartment 90 may be open/closed by an ice storage compartment cover 140. The ice storage compartment cover 140 may be rotatably provided while having a hinge axis 141 as a center. The ice storage compartment cover 140 includes a locking apparatus (not shown), and the ice storage compartment cover 140 may be locked as the locking apparatus is hooked at a locking hole 142.

The ice storage compartment 90 may be provided with the approximate shape of a box, and may include an upper wall 91, a left side wall 92, a right side wall 93, a bottom 94, and a rear wall 95. The ice storage compartment 90 and the ice storage compartment cover 140 may include insulation material to insulate the ice bucket 110.

The upper wall 91 of the ice storage compartment 90 may be provided with a cool air inlet 97 formed thereto so that cool air may be input through the cool air inlet 97 to the ice bucket 110, a cool air outlet 98 formed thereto so that the cool air of the ice bucket 110 may be output through the cool air outlet 98. An ice inlet 99 may be formed thereto so that ice may be input to the ice bucket 110 through the ice inlet 99. According to an exemplary embodiment, the cool air inlet 97 and the ice inlet 99 may be integrally formed, but are not limited hereto, and may be separately formed.

A coupler passing unit 106 through which a driven coupler 124 of the ice bucket 110 may be passed may be formed at the upper wall 91 of the ice storage compartment 90.

The upper wall 91 of the ice storage compartment 90 may be provided with a sealing member 104 to seal the cool air inlet 97 and the cool air outlet 98. The sealing member 104 may be formed with rubber material. The sealing member 94 may be formed in the shape of a ring at the surroundings of the cool air inlet 97 and the cool air outlet 98. When the door 30 is closed, the sealing member 104 may seal the the cool air inlet 97 and the cool air outlet 98, for example, while closely attached to a front cover unit 61 of the cover plate 50 of the body 10.

The bottom 94 of the ice storage compartment 90 may be provided with an ice outlet 101 formed thereto so that the ice at the ice bucket 110 may be output to the dispenser 34 through the ice outlet 101.

The ice bucket 110 includes an ice bucket body, and an ice storage space 101 formed inside of the ice bucket body. The ice bucket body may be provided with the approximate shape of a box, and may include an upper wall, a bottom, a front wall, a right side wall, a rear wall, and a left side wall.

The upper wall 102 of the ice bucket 110 may be provided with a cool air inlet 117 through which cool air may be input, a cool air outlet 118 through which cool air is output, and an ice inlet 119 through which ice is input. According to an exemplary embodiment, the cool air inlet 117 and the ice inlet 119 are integrally formed, but are not limited hereto, and may be separately formed.

The cool air inlet 117 of the ice bucket 110 and the cool air inlet 97 of the ice storage compartment 90 may be formed at positions corresponding to each other. The cool air outlet 118 of the ice bucket 110 and the cool air outlet 98 of the ice storage compartment 90 may be formed at positions that correspond to each other. The ice inlet 119 of the ice bucket 110 and the ice inlet 99 of the ice storage compartment 90 may be formed at positions that correspond to each other.

According to an exemplary embodiment, the cool air inlet 117 of the ice bucket 110 may be provided adjacent to the right side wall 113 of the ice bucket 110, and the cool air outlet 118 of the ice bucket 110 may be provided adjacent to the left side wall 113 of the ice bucket 110, but are not limited hereto, and the positions thereof may be exchanged.

The upper wall 111 of the ice bucket 110 may be provided with a driven coupler 124 of the ice bucket 110 positioned thereto.

The bottom 114 of the ice bucket 110 may be provided with an ice outlet 121 formed thereto so that the ice at the ice bucket 110 is output to the dispenser 34 through the ice outlet 121. The ice outlet 12 of the ice bucket 110 and the ice outlet 101 of the ice storage compartment 90 may be formed at positions that correspond to each other.

An ice storage space 120 of the ice bucket 110 may be provided with a stirrer 122 so that ice may be easily output through the ice outlet 121 by stirring the ice stored at the ice storage space 120. The stirrer 122 may be rotatably provided, and may rotate by receiving a rotational force from a stirring motor (not shown) provided at the body 10. The rotational force of the stirring motor may be delivered to the stirrer 122 through a driving coupler 123 provided at the body 10, and through the driven coupler 124 provided at an upper end of the stirrer 122.

The driving coupler 123 and the driven coupler 124 may be separated from each other when the door 3 is open, and when the door 30 is closed, the driving coupler 123 and the driven coupler 124 may be coupled to each other to deliver a driving force.

The cool air of the cooling space 60 of the body 10 may be to the ice storage space 120 of the ice bucket 110 through the cool air inlet 117 of the ice bucket 110. The cool air that is heated after cooling the ice stored at the ice storage compartment 120 may be collected to the cooling space 60 of the body 10 through the cool air outlet 118 of the ice bucket 110.

An ice detecting sensor, for example, a full-ice detecting sensor 150 may detect the ice level, for example, the full-ice status at the ice bucket 110. An optical hole 125 may be formed at the ice bucket 110 so that the optical signals transmitted/received at the full-ice detecting sensor may be passed therethrough.

Figure 6:
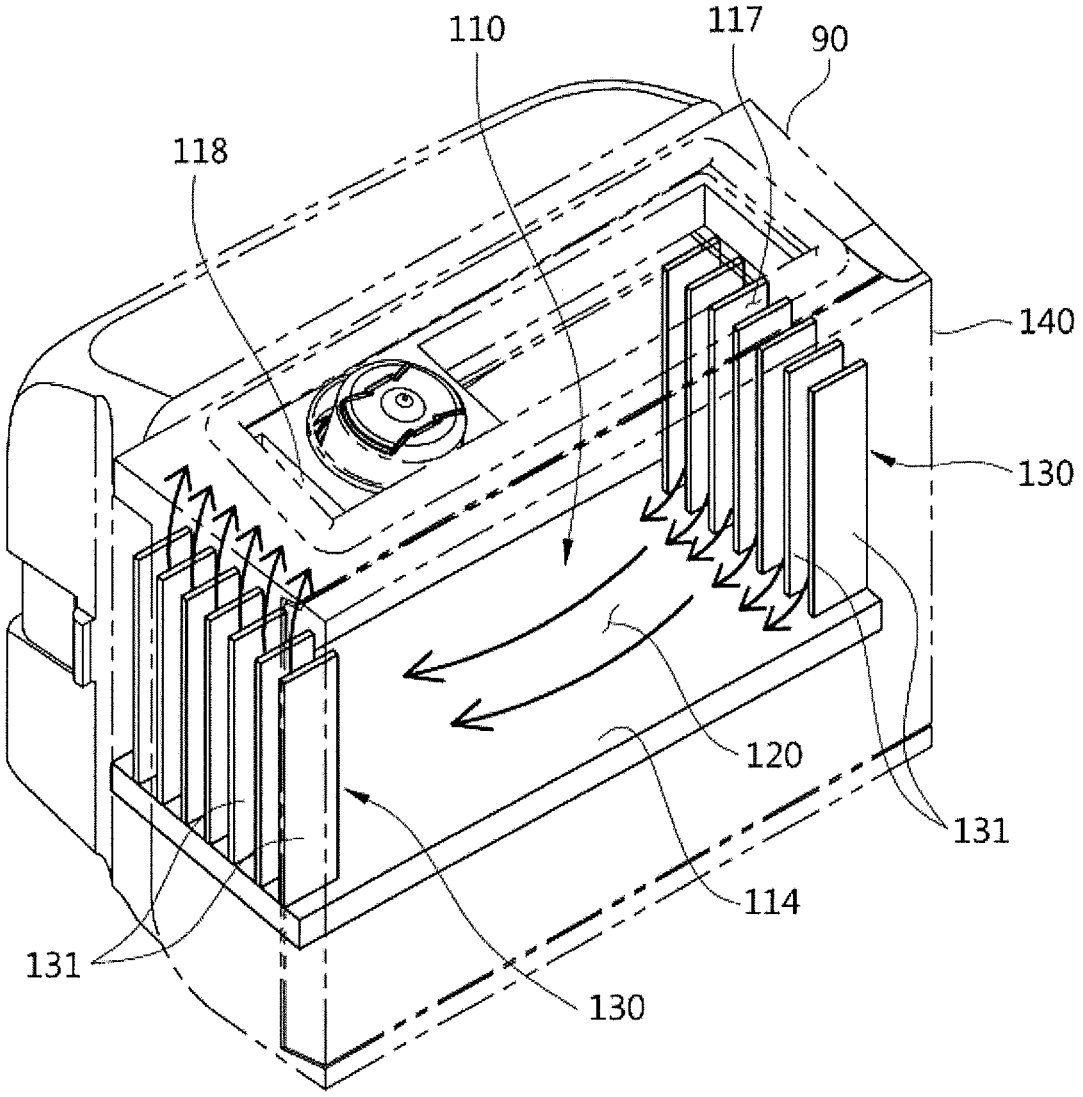
FIG. 6 illustrates an exemplary ice bucket of the refrigerator of FIG. 1.
Figure 7:
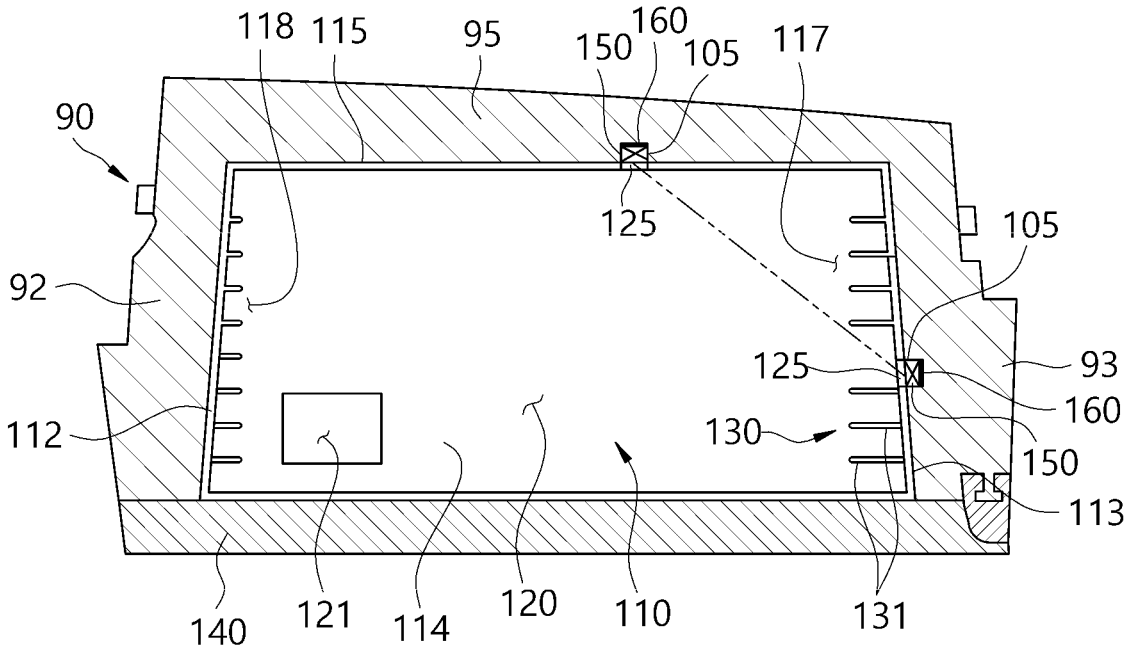
FIG. 7 is an exemplary plane view of the ice bucket of the refrigerator of FIG. 1.

FIG. 6 illustrates an inside of the ice bucket of the refrigerator of FIG. 1, and FIG. 7 is a plane view of the ice bucket of the refrigerator of FIG. 1.

Referring to FIG. 6 and FIG. 7, the ice bucket 110 may include a spacing member 130 provided such that the circulation of cool air may easily occur as the cool air is output through the cool air outlet 118 to an outside after the cool air is input through the cool air inlet 117 to the ice storage space 120.

The spacing member 130 may be capable of having the circulation of cool air easily occur by allowing a flow path of the cool air in between ice and the ice bucket body by spacing the ice stored at the ice storage space 120 of the ice bucket 110 apart from the ice bucket body toward the ice storage space 120.

The spacing member 130 has adequate strength not to be broken or separated by a collision with ice. The spacing member 130 may be integrally formed with the ice bucket 110. The spacing member 130 may be formed with an identical material of the ice bucket 110.

The ice bucket 110 may include a plurality of guide ribs 131 extendedly formed in lengthways in vertical directions at the right side wall 113 and the left side wall 112 of the ice bucket 110 that are adjacent to the cool air inlet 117 and the cool air outlet 118 of the ice bucket 110, respectively.

The plurality of guide ribs 131 may space ice from the right side wall 113 apart from and the left side wall 112. The plurality of guide ribs 131 may be extended in vertical direction to guide the cool air inlet through the cool air inlet 117 to the ice storage space 120 toward a lower direction, and may guide the cool air being outlet through the cool air outlet 118 to an outside toward an upper direction.

The adjacent ribs from the plurality of guide ribs 131 may be provided to be spaced apart to each other by a predetermined gap as to form a flow path of cool air in between the adjacent guide ribs 131.

According to an exemplary embodiment, the guide rib 131 is bar shaped, but the shape of the guide rib 131 is not limited, and may be provided with a partially bent shape or a curved shape. According to an exemplary embodiment, the guide rib 131 may be provided to be approximately perpendicular to a wall or bottom surface, but is not limited hereto, and, the guide rib 131 may be inclinedly provided in some degree.

According to an embodiment, as the cool air inlet 117 and the cool air outlet 118 of the ice bucket 110 are adjacently formed at the right side wall 113 and the left side wall 112 of the ice bucket 110, respectively, the plurality of guide ribs 131 are provided at the right side wall 113 and the left side wall 112 of the ice bucket 110, respectively. According to an embodiment, the positions of the cool air inlet 117 and the cool air outlet 118 of the ice bucket 110, the positions of the plurality of guide ribs 131 as well may be changed.

As illustrated in FIGS. 6-7, the refrigerator 1 in accordance with an embodiment of the present disclosure may include an ice level detecting sensor, e.g., a full-ice detecting sensor 150 to detect the ice level status, e.g., the full-ice status at the ice bucket 110.

The full-ice detecting sensor 150 may be an optical sensor having an emitter to radiate optical signals including infrared light, and a receiver to receive the optical signals radiated from the emitter and output the value of the received optical signals. Hereinafter, the terminology referred to as the full-ice detecting sensor 150 will used as a terminology referring to the both of the emitter and the receiver, or one of the emitter and the receiver.

The refrigerator may include a control unit 200 (see, for example, FIG. 10) to control a driving of an ice-making cycle having a supplying of water to supply water to the ice making device 80, a making of ice to cool the ice making device 80, a moving of ice to move the ice generated at the ice making device 80 to the ice bucket 110, and a determining of full-ice status to determine the full-ice status at the ice bucket 110.

The control unit 200 may determine that the ice bucket 110 is full of ice when the value output at the full-ice detecting sensor 150 is less than a predetermined reference value. As an example, when the output value is less than 1 V, the ice bucket 110 may be determined to be full with ice.

The control unit 200 may finish the ice-making cycle upon determining that the ice bucket 110 is full with ice. When determining that the ice bucket 110 is not full with ice, the control unit 200 may repeatedly continue the ice-making cycle.

A method of determining the full-ice status by the control unit 200 is described.

The full-ice detecting sensor 150 may be installed at the ice storage compartment 90 to detect the full-ice status at the ice bucket 110. The full-ice detecting sensor 150 may be embedded at the left side wall 93 and the rear wall 95 of the ice storage compartment 90. The full-ice detecting sensor 150 may be provided to be positioned at an outside the ice bucket 110. Therefore, the ice bucket 110 and the full-ice detecting sensor 150 may not be disturbed during mounting or dismounting the ice bucket 110 at the ice storage compartment 90.

A mounting groove 105 at which the full-ice detecting sensor 150 may be mounted may be formed at the each of the left side wall 93 and the rear wall 95 of the ice storage compartment 90, and the full-ice detecting sensor 150 may be accommodated at the mounting groove 105.

Therefore, with respect to the optical path in between the emitter and the receiver, a diagonal path may be formed. As the optical path in between the emitter and the receiver may be provided to be a diagonal path, the optical path may be minimized within the limit in which the full-ice status is detected.

According to an exemplary embodiment, the full-ice detecting sensor 150 may be provided at the each of the left side wall 93 and the right side wall 92 of the ice storage compartment 90, or may be provided at each of the right side wall 92 and the rear wall 95 of the ice storage compartment 90.

The ice bucket 110 may be provided with an optical hole 125 formed thereto so that the optical signals transmitted/received at the full-ice detecting sensor 150 may be passed through an inside the ice bucket 110. According to an exemplary embodiment, the optical hole 125 may be formed at the each of the right side wall 113 and the rear wall 115 of the ice bucket 110 to correspond to the position of the full-ice detecting sensor 150.

The full-ice detecting sensor 150 may be installed at an adjacent position with respect to the ice bucket 110, and as the full-ice detecting sensor 150 may be stably fixed even when the ice bucket 110 is mounted and dismounted, the reliability in detecting the full-ice status may be increased, and the durability of the full-ice detecting sensor 150 may be increased.

A sensor heater 160 may radiate heat to defrost the full-ice detecting sensor 150.

Figure 8:
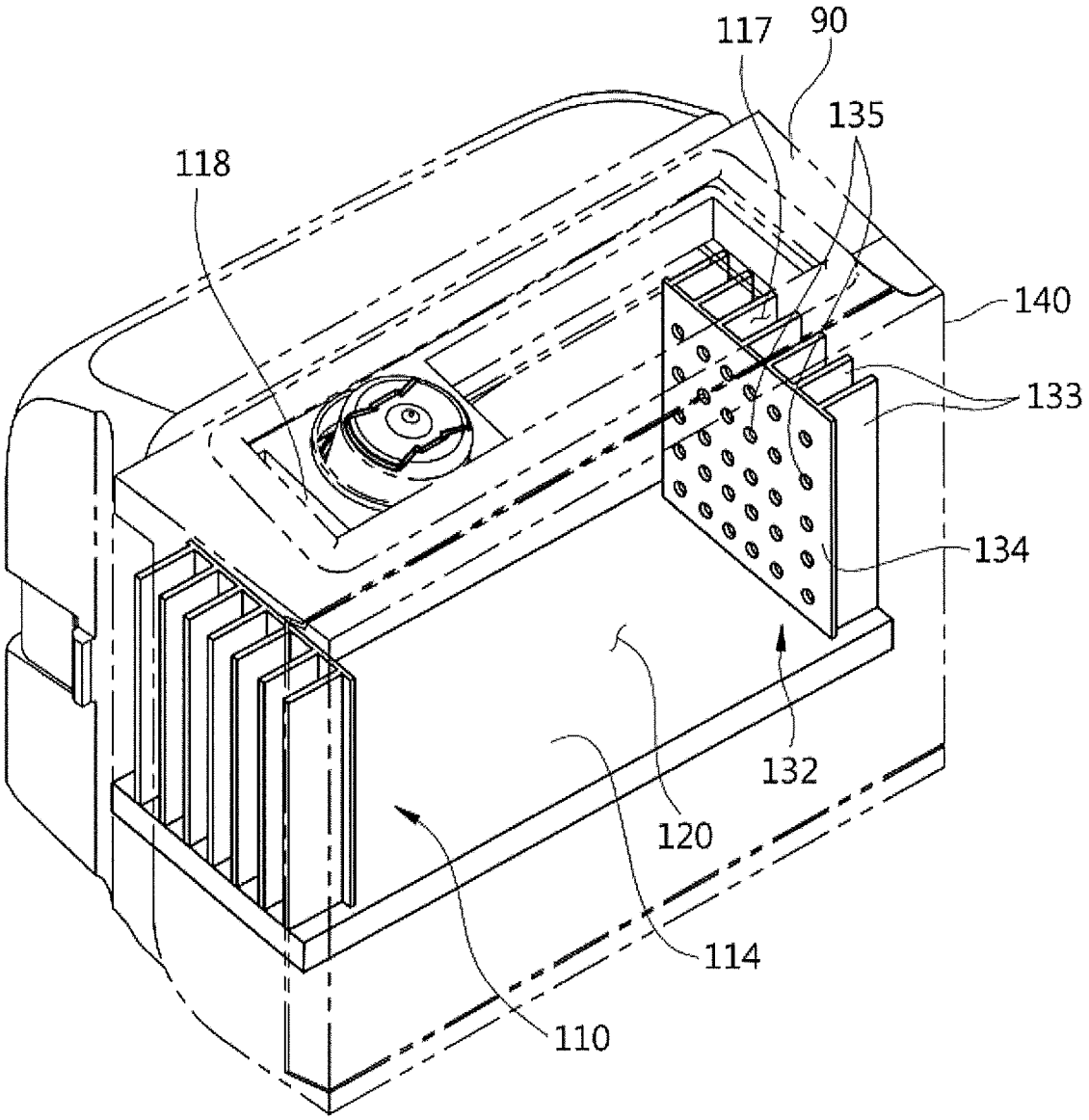
FIG. 8 illustrates an exemplary spacing member in accordance with an embodiment of the present disclosure.
Figure 9:
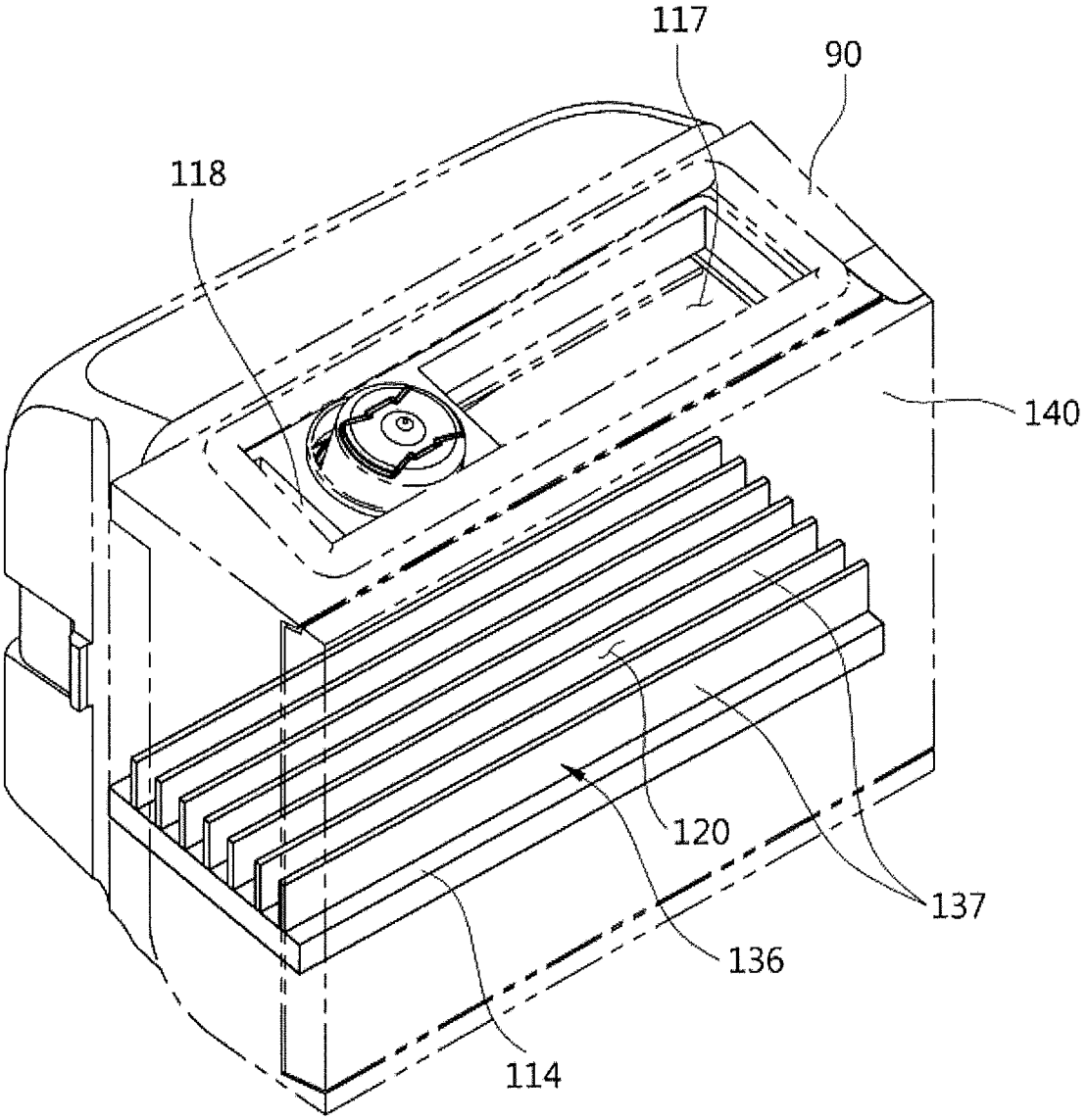
FIG. 9 illustrates an exemplary spacing member in accordance with an embodiment of the present disclosure.

FIG. 8 illustrates a spacing member in accordance with an embodiment of the present disclosure, and FIG. 9 illustrates a spacing member in accordance with still an embodiment of the present disclosure.

Referring to FIG. 8 and FIG. 9, different embodiments of a spacing member are described. With respect to the identical structure to the embodiments described previously, the same numeric figures will be designated while descriptions may be omitted.

As illustrated on FIG. 8, a spacing member 132 may include a plurality of guide ribs 133 extendedly formed lengthways in a vertical direction at both side walls of the ice bucket 110 that are adjacent to the cool air inlet 117 and the cool air outlet 118 of the ice bucket 110, and a dividing wall 134 formed at an inner side of the plurality of guide ribs 133.

The plurality of guide ribs 133 may space apart ice from both the side walls of the ice bucket 110. The plurality of guide ribs 133 may be extended in vertical directions, and may guide the cool air inlet to the ice storage space 120 through the cool air inlet 117 toward a lower direction, and may guide the cool air outlet to an outside though the cool air outlet 118 toward an upper direction.

The adjacent guide ribs 133 from the plurality of guide ribs 133 may form a cool air flow path in between the adjacent guide ribs 133 while spaced apart from each other by a predetermined space.

The dividing wall 134 may divide the ice storage space 120 of the ice bucket 110 into an outside cool air flow path domain and an inside ice storage domain. The dividing wall 134 may be formed in the shape of a plate. The dividing wall 134 may be perpendicularly provided with respect to the guide rib 133.

The dividing wall 134 may be provided with a cool air communicating hole 135 such that cool air may be communicated after penetrating through the dividing wall 134. The plurality of guide ribs 133 and the dividing wall 134 may be integrally formed to each other, or may be coupled to each other while provided separately.

As illustrated on FIG. 9, a spacing member 136 may include a plurality of guide ribs 137 extendedly formed lengthways toward horizontal directions at the bottom 114 of the ice bucket 110. The plurality of guide ribs 137 may be extended lengthways in a direction from the cool air inlet 117 of the ice bucket 110 in a direction towards the cool air outlet 118 of the ice bucket 110.

The plurality of guide ribs 137 may space apart ice from the bottom 114 of the ice bucket 110, and may guide the cool air inlet to the cool air inlet 117 of the ice bucket 110 to the cool air outlet 118 of the ice bucket 110.

The adjacent guide ribs 137 from the plurality of guide ribs 137 may form a cool air flow path in between the adjacent guide ribs 137 while spaced apart from each other by a predetermined space.

Figure 10:
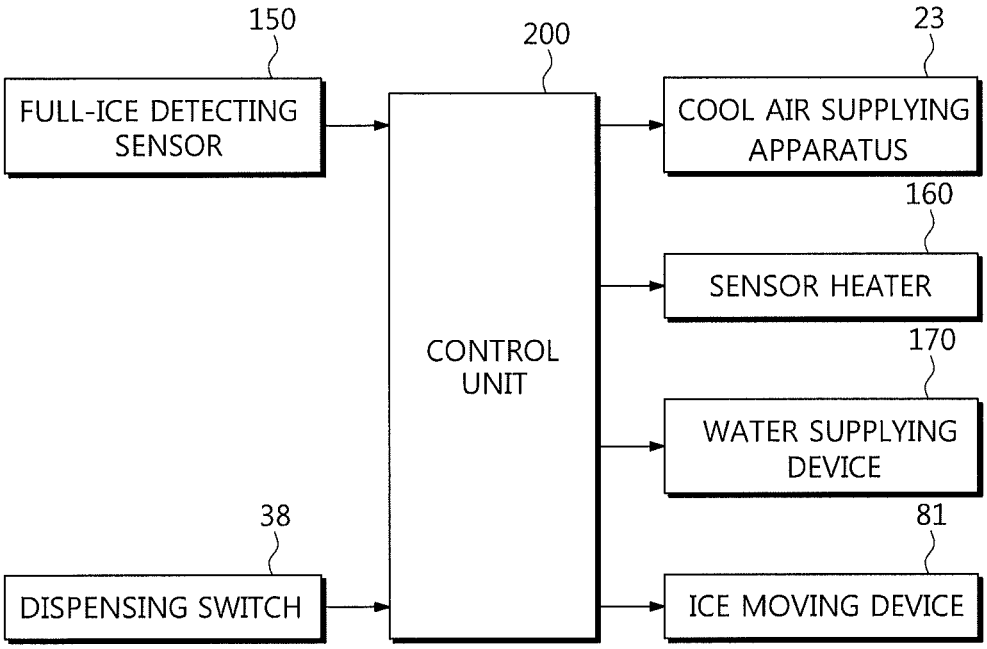
FIG. 10 is a block diagram illustrating an exemplary ice-making process of the present disclosure.
Figure 11:
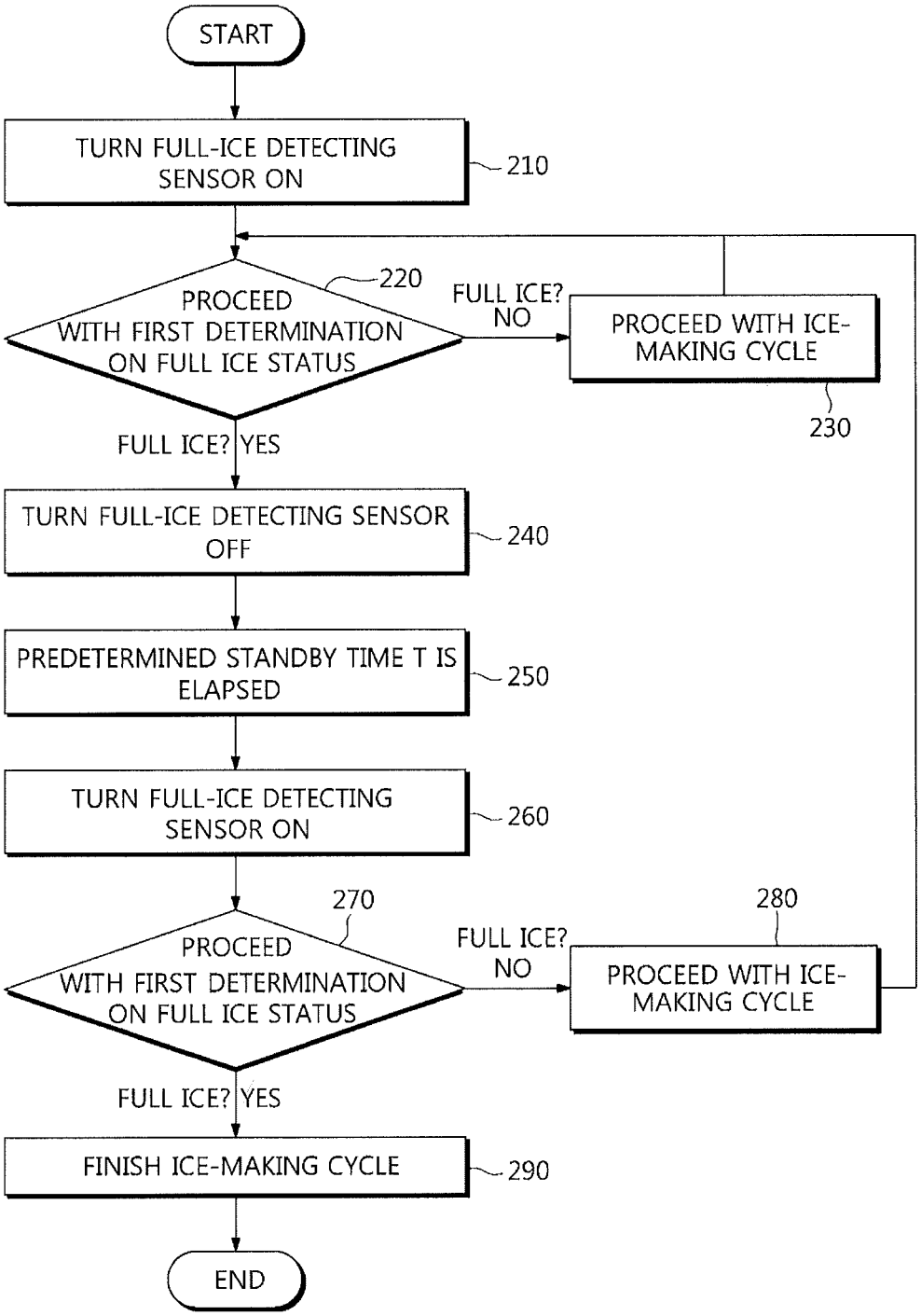
FIG. 11 is a flow chart illustrating an exemplary detecting a full-ice status in accordance with an embodiment of the present disclosure.
Figure 12:
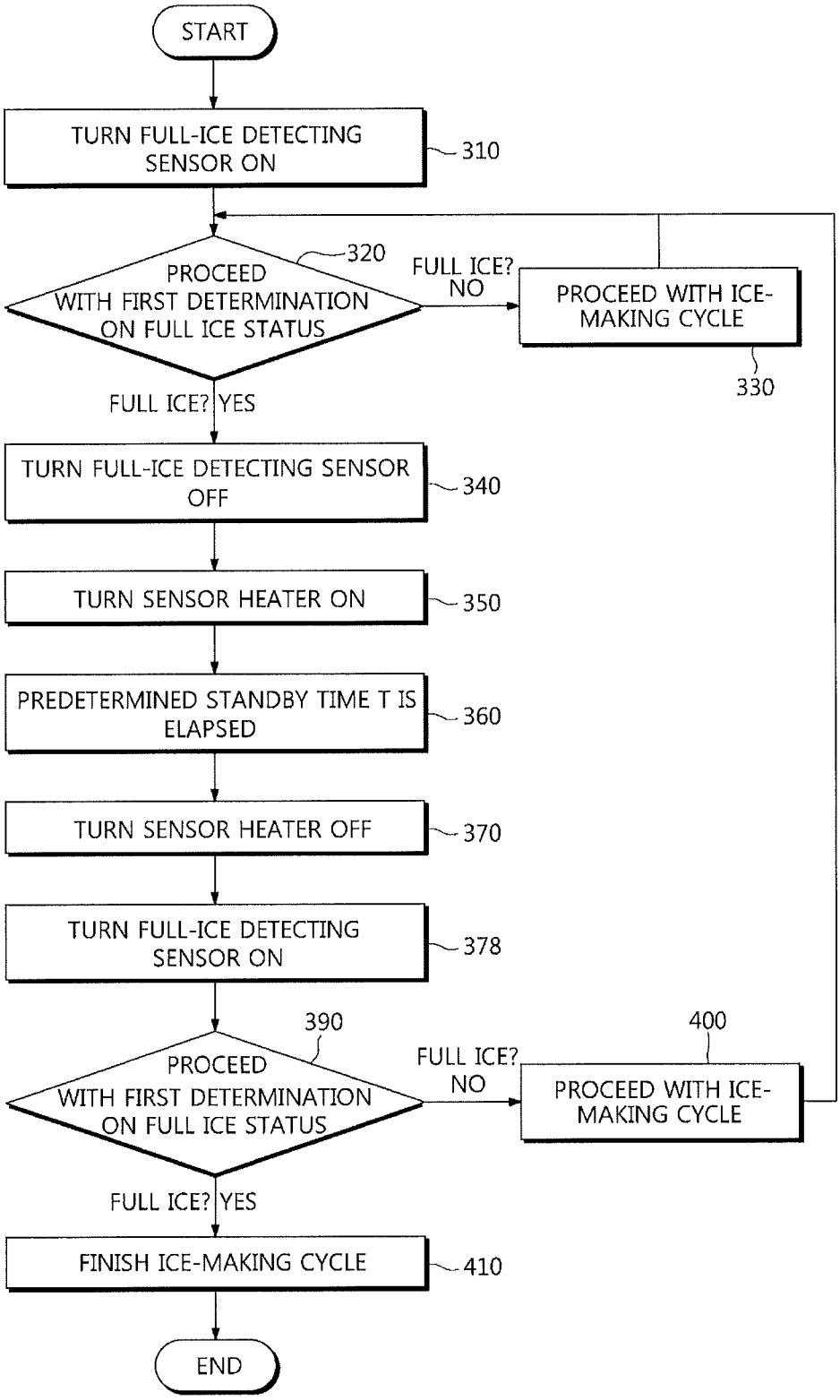
FIG. 12 is a flow chart illustrating an exemplary detecting a full-ice status in accordance with an embodiment of the present disclosure.

FIG. 10 is a block diagram to describe an exemplary ice-making process of the present disclosure, FIG. 11 illustrates detecting a full-ice status in accordance with an embodiment of the present disclosure, and FIG. 12 illustrates detecting a full-ice status in accordance with an embodiment of the present disclosure.

Referring to FIG. 10 to FIG. 12, methods of detecting a making of ice and a full-ice status of the refrigerator in accordance with an embodiment of the present disclosure will be described.

The control unit 200 may control proceeding and finishing of an ice-making cycle including a determining of a full-ice status at the ice bucket 110 by use of a delivered output value of the optical signals that are received from the full-ice detecting sensor 150, a supplying of water, a making of ice, a moving of ice, and a detecting of the full-ice status depending on the full-ice status at the ice bucket 110.

The control unit 200 may control a proceeding of an ice-making cycle after determining that the ice at the ice bucket 110 is output according to the motion of the dispensing switch 38 of the dispenser 34.

The control unit 200 may supply water to the ice making device 80 by controlling a water supplying device 170, cool the ice making device 80 by controlling the cool air supplying apparatus 23, and move ice from the ice making device 80 by rotating the scraper (not shown) through controlling the ice-moving device 81.

The control unit 200 may heat the full-ice detecting sensor 150 by controlling the sensor heater 160.

As illustrated on FIG. 11, in accordance with an embodiment of the present disclosure, the control unit 200 may be provided to standby for a predetermined standby time T after the first determination on the full-ice status at the ice bucket 110 is made (220), and may finally determine the full-ice status by performing a process of the second determination on the full-ice status at the ice bucket 110 (270).

That is, the control unit 200 is provided to turn the full-ice detecting sensor (210) on, and may proceed with the first determination on the full-ice status at the ice bucket 110 (220). The first determination on the full-ice status may be made by comparing the value of the optical signals output from the full-ice detecting sensor 150 and a predetermined reference value. As an example, when the value of the optical signals output from the full-ice detecting sensor 150 is greater than the predetermined reference value, a determination may be made that the full-ice status is not reached, and when the value of the optical signals output from the full-ice detecting sensor 150 is less than the predetermined reference value, a determination may be made that the full-ice status is reached.

When determined that the full-ice status is not reached after the first determination on the full-ice status is proceeded, the control unit 200 is provided to proceed again with the ice-making cycle including the supplying of water, the making of ice, the moving of ice, and the detecting of full-ice status to store ice at the ice bucket 110 (230), and is provided to proceed again with the process of the first determination on the full-ice status.

When determined that the full-ice status is reached after proceeding with the first determination on the full-ice status, the control unit 200 turns the full-ice detecting sensor (240) off, and the ice-making cycle to standby during the predetermined standby time T. That is, the control unit 200, even when it is determined that the full-ice status is reached after proceeding with the first determination on the full-ice status, standbys during the predetermined standby time T (250) without immediately finishing the ice-making cycle.

Thus, an error is prevented, for example, in a determination of a full-ice status of the ice bucket 110. As an example, in a case when ice is unevenly stacked from the bottom of the ice bucket 110, ice may further be stored. However, the ice at the uppermost position in the ice bucket 110 may momentarily disturb the optical signals, so that a determination may be erroneously made that the full-ice status is reached, while the actual status may not be an actual the full-ice status.

The control unit 200, when the predetermined standby time T is elapsed, may turn the full-ice detecting sensor 150 on (260) to proceed with the second determination of the full-ice status (270).

When a determination is made that the full-ice status is not reached after proceeding with the second determination of the full-ice status, the ice-making cycle proceed again (280), and the process of the first determination on the full-ice status again proceeds (220).

When a determination is made that the full-ice status is reached after proceeding with the second determination on the full-ice status, the ice-making cycle is finished (290).

As illustrated on FIG. 12, the control unit 200 in accordance with an embodiment of the present disclosure may be provided to standby for a predetermined standby time T after the first determination is made that the full-ice status is reached at the ice bucket 110 (320), and may finally determine the full-ice status by performing a process of the second determination on the full-ice status at the ice bucket 110 (390). The frost at the full-ice detecting sensor 150 may be removed by turning ON/OFF the sensor heater 160 (see, for example, FIG. 7) in between the time when the first determination is made that the full-ice status is reached at the ice bucket 110 (320) and when the second determination is made that the full-ice status is reached at the ice bucket 110 (390).

That is, the control unit 200 may be provided to turn the full-ice detecting sensor on (310), and may proceed with the first determination on the full-ice status at the ice bucket 110 (320). The first determination on the full-ice status may occur by comparing the value of the optical signals output from the full-ice detecting sensor 150 and a predetermined reference value. As an example, when the value of the optical signals output from the full-ice detecting sensor 150 is greater than the predetermined reference value, a determination may be made that the full-ice status is not reached, and when the value of the optical signals output from the full-ice detecting sensor 150 is less than the predetermined reference value, a determination may be made that the full-ice status is reached.

When determined that the full-ice status is not reached after proceeding with the first determination on the full-ice status, the control unit 200 may proceed again with the ice-making cycle including the supplying of water, the making of ice, the moving of ice, and the detecting of full-ice status to store ice at the ice bucket 110 (330), and proceed again with the process of the first determination on the full-ice status.

When determined that the full-ice status is reached after proceeding with the first determination on the full-ice status, the control unit 200 may turn the full-ice detecting sensor off (340), turn the sensor heater 160 on (350), and the ice-making cycle to standby during the predetermined standby time T (360). That is, the control unit 200, even when it is determined that the full-ice status is reached after proceeding with the first determination on the full-ice status, may standby during the predetermined standby time T without immediately finishing the ice-making cycle.

The full-ice detecting sensor 150 may be heated by driving the sensor heater 160 as to eliminate a possibility of error, which may be caused by frost at the full-ice detecting sensor 150, in detecting the full-ice status.

The control unit 200, when the predetermined standby time T is elapsed, turn the sensor heater 160 off (370) to proceed with the second determination on the full-ice status (390).

When a determination is made that the full-ice status is not reached after proceeding with the second determination on the full-ice status, the ice-making cycle again proceeds (400), and the process of the first determination on the full-ice status is proceeded again (320).

When a determination is made that the full-ice status is reached after proceeding with the second determination on the full-ice status, the ice-making cycle is finished (410).

As is apparent from the above, in accordance with an aspect of the present disclosure, a circulation of cool air at an inside an ice bucket can be easily occur.

In accordance with the aspect of the present disclosure, reliability of a full-ice detecting structure including a full-ice detecting sensor having an emitter to radiate optical signals and a receiver to receive optical signals can be increased.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body having a storage compartment;

a door to open/close the storage compartment;

an ice maker disposed at a ceiling of the storage compartment and configured to generate ice;

an ice storage compartment provided at the door;

an ice bucket mounted at the ice storage compartment to store the ice generated by the ice maker and including a front side, a right side, a left side and a rear side; and a full-ice detecting sensor, including an emitter to radiate an optical signal and a receiver to receive the optical signal directly, to detect a full-ice status at the ice bucket, the full-ice detecting sensor provided at the ice storage compartment and positioned at an outside of the ice bucket, and wherein one of the emitter and the receiver is positioned next to the right side or the left side, and the remaining one of the emitter and the receiver is positioned next to the rear side, so that an optical path between the emitter and the receiver is diagonally formed.

2. The refrigerator of claim 1, wherein:

the ice storage compartment comprises an ice storage compartment body having a left side wall, a right side wall, a rear wall, and a bottom, and an ice bucket mounting space formed at an inside of the ice storage compartment body.

3. The refrigerator of claim 2, wherein:

the full-ice detecting sensor is installed at the ice storage compartment body.

4. The refrigerator of claim 2, wherein:

one of the emitter and the receiver is installed at a left side wall or a right side wall of the ice storage compartment, and the remaining one of the emitter and the receiver is installed at a rear wall of the ice storage compartment.

5. The refrigerator of claim 1, wherein:

the ice bucket comprises an ice bucket body and a storage space formed at an inside of the ice bucket body, and an optical hole is formed at the ice bucket body so that the optical signals transmitted/received through the full-ice detecting sensor are penetrated through the ice bucket body.

6. A refrigerator, comprising:

a body having a storage compartment;

an ice maker configured to generate ice;

a water supply to supply water to the ice maker;

an ice bucket to store ice and including a right side, a left side and a rear side;

an ice mover to move the ice generated at the ice maker to the ice bucket;

a full-ice detecting sensor having an emitter to radiate an optical signal to an inside of the ice bucket, and a receiver to receive the optical signal radiated from the emitter directly and output a value of the received optical signal, and wherein one of the emitter and the receiver is positioned next to the right side of the ice bucket or the left side of the ice bucket, and the remaining one of the emitter and the receiver is positioned next to the rear side of the ice bucket, so that the optical path between the emitter and the receiver is diagonally formed; and a controller to primarily determine a full-ice status by turning on the full-ice detecting sensor, turning off the full-ice detecting sensor during a predetermined standby time upon determining a full-ice status as a result of the primary determination of the full-ice status, and secondarily determine the full-ice status by turning on the full-ice detecting sensor when the predetermined standby time is elapsed.

7. The refrigerator of claim 6, wherein:

the controller controls the ice mover and the water supply to finish an ice-making cycle having a supplying of water, and a making of ice, and a moving of ice, upon determining a status to be the full-ice status as a result of the secondary determination on the full-ice status.

8. The refrigerator of claim 6, wherein:

the controller controls the ice mover and the water supply to proceed with an ice-making cycle having a supplying of water, a making of ice, and a moving of ice, upon determining not to be in the full-ice status as a result of the secondary determination on the full-ice status.

9. The refrigerator of claim 6, wherein:

the controller controls the ice mover and the water supply to proceed with an ice-making cycle including a supplying of water, a making of ice, and a moving of ice, upon determining not to be in the full-ice status as a result of the secondary determination on the full-ice status.

10. The refrigerator of claim 6, further comprising:

a sensor heater to heat the full-ice detecting sensor, wherein the controller turns ON the sensor heater to heat the full-ice detecting sensor upon determining to be in the full-ice status as a result of the primary determination of the full-ice status.

11. The refrigerator of claim 10, wherein:

the controller turns OFF the sensor heater when the predetermined standby time is elapsed.

* * * * *